US007481420B2

(12) United States Patent
Iwamoto et al.

(10) Patent No.: US 7,481,420 B2
(45) Date of Patent: Jan. 27, 2009

(54) APPARATUS OF FEEDING MAILPIECES

(75) Inventors: Yasuhiko Iwamoto, 47-321, Chaya, Kyowa-Machi, Obu-shi, Aichi-Prefecture (JP); Kenji Iwamoto, c/o Kabushiki Kaisha Some Giken, 6-1-9, Tokai-Machi, Aichi-Prefecture (JP)

(73) Assignees: Yasuhiko Iwamoto, Obu-Shi (JP); Kenji Iwamoto, Tokai-Shi (JP)

( * ) Notice: Subject to any disclaimer, the term of this patent is extended or adjusted under 35 U.S.C. 154(b) by 439 days.

(21) Appl. No.: 11/337,879

(22) Filed: Jan. 23, 2006

(65) Prior Publication Data

US 2006/0162584 A1 Jul. 27, 2006

(30) Foreign Application Priority Data

Jan. 25, 2005 (JP) ..... 2005-017209
Feb. 9, 2005 (JP) ..... 2005-033461

(51) Int. Cl.
*B65H 3/12* (2006.01)

(52) U.S. Cl. ..... 271/95; 271/31.1; 271/149; 271/150; 271/151

(58) Field of Classification Search ..... 271/94, 271/95, 30.1, 31.1, 149, 150, 151
See application file for complete search history.

(56) References Cited

U.S. PATENT DOCUMENTS 3,386,558 A * 6/1968 Benatar ..... 198/408
4,194,442 A * 3/1980 Martelli ..... 493/316
5,054,761 A * 10/1991 Dietrich et al. ..... 271/95
5,061,231 A * 10/1991 Dietrich et al. ..... 493/315
5,511,722 A * 4/1996 Dixon ..... 229/225
5,700,004 A * 12/1997 Bahr et al. ..... 271/171

FOREIGN PATENT DOCUMENTS

JP 2003-225619 A1 8/2003
JP 2003-248712 A1 9/2003
JP 2004-083189 A1 3/2004

* cited by examiner

*Primary Examiner*—David H Bollinger
(74) *Attorney, Agent, or Firm*—Burr & Brown

(57) ABSTRACT

An apparatus of feeding mailpieces such as envelopes is disclosed. The apparatus includes a supply conveyer for supporting thereon an array of mailpieces which are arranged in a tilted-backward position and moving such mailpieces forward, and a suction feeder which is located downstream of the supply conveyer for picking up by suction a forefront mailpiece from the array of mailpieces on the supply conveyer. The suction feeder has a rotary drum, a shaft rotatably supported in the drum and disposed with the axis thereof oriented in parallel to and offset from the axis of the drum. An external gear is fixed on the shaft for rotation therewith and a stationary internal gear engages with the external gear, the gear ratio of the external gear to the internal gear being n:n+1, wherein n represents an integer. A plurality of suction means arranged at positions radially spaced at a predetermined distance from the shaft and substantially equiangularly spaced from each other and movable integrally with the shaft in conjunction with the rotation of the drum for picking up each forefront mailpiece from the array of mailpieces on the supply conveyer.

12 Claims, 11 Drawing Sheets

APPARATUS OF FEEDING MAILPIECES

BACKGROUND OF THE INVENTION

This application claims the benefit of Japanese Patent Application Numbers 2005-17209 filed on Jan. 25, 2005 and 2005-33461 filed on Feb. 9, 2005, the entirety of which are incorporated by reference.

Field of the Invention

The present invention relates to an apparatus of feeding mailpieces. The apparatus of the present invention is usable advantageously as a feeder in a sorting system for sorting mailpieces or the like according to code information such as postal code, an inspection system for checking address or counting according the code, an apparatus for picking out mailpieces or the like having specific code and also in the mailpiece feeding station of a mailpiece handling apparatuses disclosed by the Unexamined Japanese Patent Application Publications (or Kokai publications) No. 2003-225619 or No. 2003-248712 both assigned to the same assignee as the present invention.

It is noted that the term "mailpiece" used herein will refer not only to postal mailpiece such as envelope or parcel, but it also includes those various kinds of materials which are dealt with by private door-to-door delivery service or by posting service and also that the envelope that is a most typical mailpiece is not limited only to paper envelopes, but it includes film envelopes, plastic envelopes, film wrapping, etc.

According to a conventional apparatus known in the art to which the present invention pertains, a number of envelopes is arranged in a vertical pile and the envelope at the bottom of the pile is moved out one after another by any suitable feeding means such as friction roll or belt or suction belt. A gate is provide at one end of the envelopes and the daylight of the gate is adjustable so that only one envelope is passed therethrough and overlapped envelopes are prevented from being transferred through the gate. When the pile includes an envelope having an irregular thickness or envelopes whose thicknesses are different from one another, however, the apparatus is not capable of handling such envelopes successfully in that overlapped envelopes are allowed through the passageway of the gate.

A rotary type envelope feeding apparatus which is disclosed by the Unexamined Japanese Patent Application Publication (or Kokai publication) No. 2004-83189 and assigned to the same assignee as the present invention has solved the above problem by making possible stabilized feeding of envelopes having different thicknesses. However, the apparatus still has a problem in that it is complicated in structure and hence costly to manufacture and also poor in durability. Additionally, since the envelopes are arranged substantially in upright position, a large buffer (or temporary storage of envelopes) cannot be provided and, therefore, frequent envelope replenishment must be done. Furthermore, operation of the apparatus has called for a skilled workman.

SUMMARY OF THE INVENTION

Therefore, it is an object of the present invention to provide a mailpiece feeding apparatus which can solve the above problems. Specifically, the present invention is directed to provide a mailpiece feeding apparatus which is designed and constructed to make possible continuous mailpiece feeding operation by using suction pick-up means such as suction pad which is moved continuously without making interrupted movement such as reciprocal motion, thereby permitting smooth and fast mailpiece feeding operation.

To achieve the object of the invention, the invention provides a mailpiece feeding apparatus which comprises a supply conveyer for supporting thereon an array of mailpieces and moving such mailpieces forward and a suction feeder which is located adjacent to the downstream end of the supply conveyer as viewed in the direction in which the mailpieces are moved by the supply conveyer. All mailpieces arranged on the supply conveyer are tilted backward, or slanted with the bottom edge of the mailpieces located forward of the opposite top edge thereof. The suction feeder is operable to pick up by suction a forefront mailpiece from the array of mailpieces on the supply conveyer.

The suction feeder has a drum which is rotatable about its axis and a shaft which rotatably supported in the drum and extends with the axis thereof oriented in parallel to the axis of the drum. The shaft is disposed with its axis offset from the axis of the drum. An external gear is fixed on the shaft for rotation therewith and a stationary internal gear is provided which engages with the external gear. The gear ratio of the external gear to the internal gear is n:n+1, wherein n represents an integer, and, in the preferred embodiments of the present invention, the gear ratio should preferably be 4:5. The suction feeder further has a plurality of suction means, or suction pads in the preferred embodiments, which are arranged at positions that are radially spaced at a predetermined distance from the shaft and substantially equally angularly spaced from each other. In the case where the gear ratio of the external and internal gears is 4:5, the suction means are arranged at four equiangularly spaced positions. The suction means are movable integrally with the shaft in conjunction with the rotation of the drum for picking up each forefront mailpiece from the array of mailpieces on the supply conveyer.

The present invention further provides a mailpiece feeding apparatus which comprises a suction feeder whose structure is different from the above suction feeder. The suction feeder has a drum which is rotatable about its axis and a first shaft which is rotatably supported in the drum. The first shaft is disposed extending with the axis thereof oriented in parallel to and offset from the axis of the drum. The first shaft has fixed thereon an external gear for rotation therewith and a stationary internal gear is provided which engages with the external gear on the first shaft. The gear ratio of the external gear to the internal gear is also n:n+1 wherein n represents an integer. In addition to the first shaft, a second shaft is rotatably supported in the drum and disposed with the axis thereof oriented in parallel to the axis of the first shaft and offset from the axis of the drum by a predetermined distance. The second shaft is connected with the first shaft by any suitable means such as cogged belt and pulleys or gears so that the first and second shafts make synchronized rotation in the same direction. The second shaft should be connected with the first shaft preferably with the speed ratio of 1:1. The above predetermined offset distance should be greater than the distance by which the axis of the first shaft is offset from the axis of the drum. A plurality of suction means such as suction pads are arranged at positions that are radially spaced at a predetermined distance from the second shaft and substantially equiangularly spaced from each other and they are movable integrally with the second shaft in conjunction with the rotation of the drum for picking up each forefront mailpiece from the array of mailpieces on the supply conveyer. As in the above first case, the gear ratio should preferably be 4:5 and the suction means are arranged at four equiangularly spaced positions.

The supply conveyer has suitable means for positioning the forefront mailpiece of the array of mailpieces at a predetermined position on the supply conveyer. The suction feeder has a suitable valve mechanism for appropriately controlling activation and deactivation of the suction means.

The above and other objects, features and advantages of the invention will become apparent to those skilled in the art from the following description of preferred embodiments of the mailpiece feeding apparatus according to the present invention, which description will be made with reference to the accompanying drawings.

DESCRIPTION OF THE PREFERRED EMBODIMENT

The following will describe a preferred embodiment of mailpiece feeding apparatus according to the present invention with reference to FIGS. 1 through 9.

Figure 1:
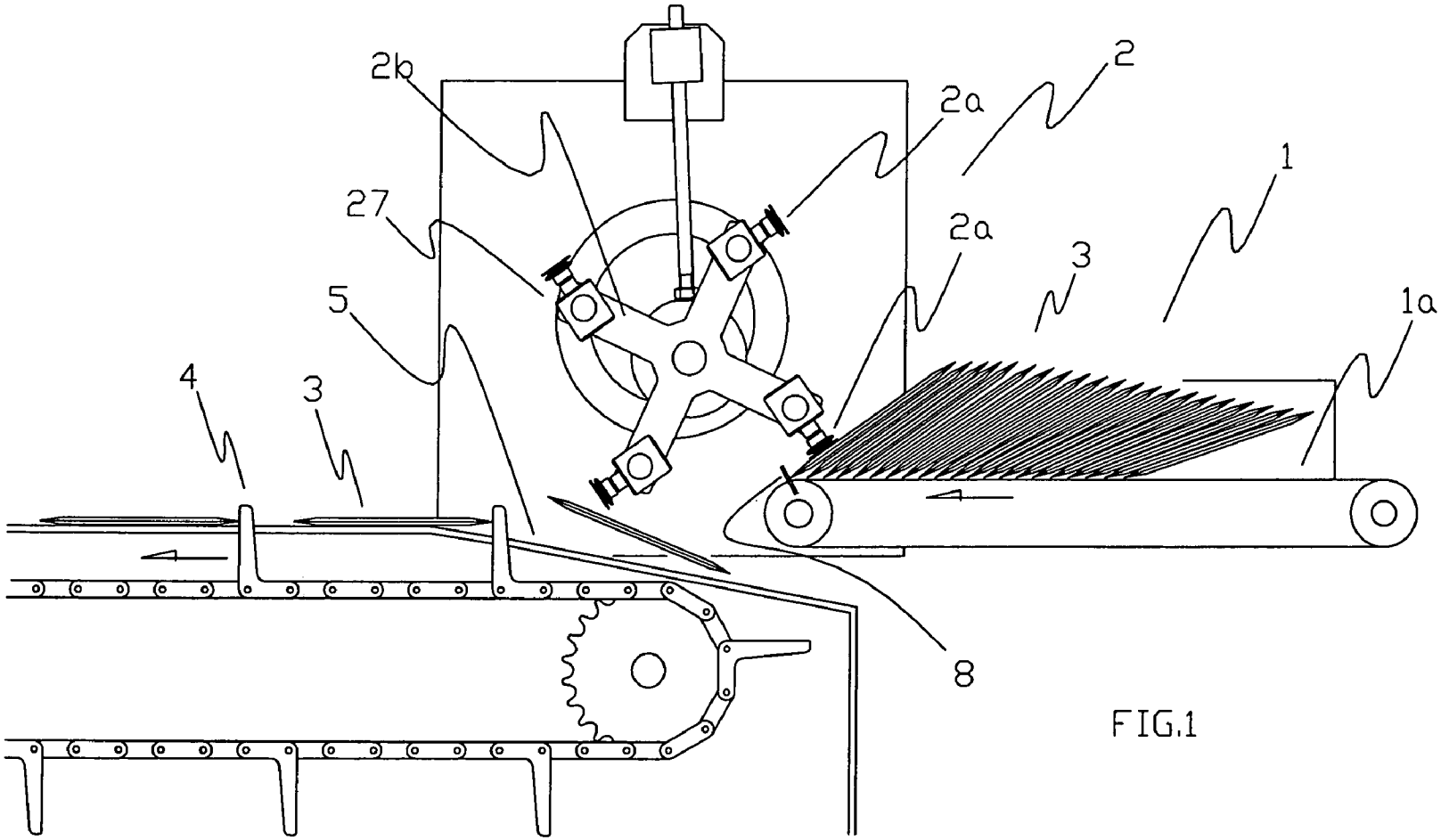
FIG. 1 is a front view of a preferred embodiment of the mailpiece feeding apparatus constructed according to the present invention, showing a mailpiece supply conveyer, a mailpiece suction feeder and a mailpiece delivery table.

Referring firstly to FIG. 1 showing the mailpiece feeding apparatus in front view, it includes a mailpiece supply conveyer which is generally designated by numeral 1 and provided in the form of an endless conveyer belt 1*a* having thereon an array of mailpieces 3. The endless conveyer belt 1*a* is trained between a pair of pulleys one of which is positively driven to move the conveyer belt 1*a* and hence the mailpieces 3 thereon in arrow direction. The mailpiece feeding apparatus further includes a mailpiece suction feeder 2 which is generally designated by numeral 2 and located adjacent to the downstream end of the mailpiece supply conveyer 1 as viewed in the direction in which the mailpieces 3 are moved by the supply conveyer 1. Immediately below the mailpiece suction feeder 2 is located one end of a mailpiece delivery table 5 which is equipped with a chain conveyer movable in arrow direction and having a plurality of chain fingers 4. Any two adjacent chain fingers 4 defines a section on the delivery table 5. The mailpiece suction feeder 2 is operable to pick up mailpieces 3 one at a time successively from the mailpiece supply conveyer 1 and transfer them in the sections on the delivery table 5. Mailpieces 3 placed on the delivery table 5 are moved by the chain finger 4 in arrow direction toward a subsequent station, for example, for address inspection or sorting according to various code information.

As shown in FIG. 1, the mailpiece suction feeder 2 has a suction pad holder 27 of a crisscross shape having four radial arms 27*a* each having at the distal end thereof a suction pad 2*a*. The suction feeder 2 is operable to pick up a mailpiece 3 which is then positioned at the forefront on the conveyer belt 1*a* by vacuum created in the suction pad 2*a* and then to transfer the mailpiece 3 onto the delivery table 5. The chain fingers 4 are movable in synchronism with the operation of the mailpiece suction feeder 2 so that each mailpiece 3 picked up by the suction pad 2*a* is placed in a right section on the delivery table 5. The mailpiece suction feeder 2 of FIG. 1 is designed and made in such a way that the suction pad 2*a* is engageable with the forefront mailpiece 3 at a position adjacent to the bottom of the mailpiece, as shown clearly in FIG. 1.

Figure 2:
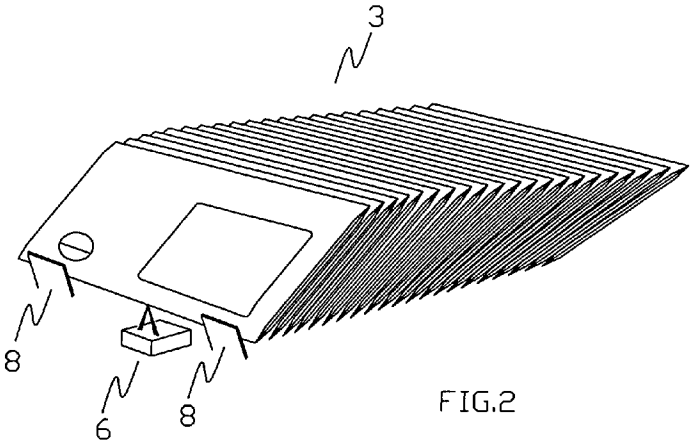
FIG. 2 is a perspective illustrative view showing an example of mailpiece sensor together with stops.
Figure 3:
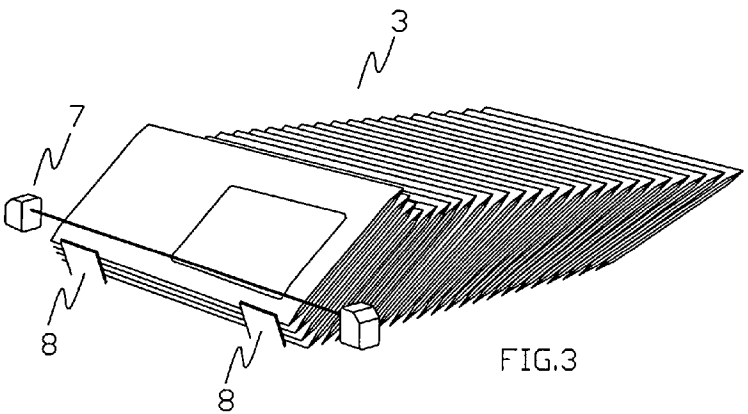
FIG. 3 is also a perspective illustrative view showing another example of mailpiece sensor together with the stops.

It is noted that all mailpieces 3 on the conveyer belt 1*a* are tilted backward or slanted with the bottom of the mailpieces 3 in contact with the conveyer belt 1*a* located forward of the opposite top of the mailpieces, as shown in FIGS. 1 through 3. This backward tilt of mailpieces 3 is advantageous in that replenishment of mailpieces 3 can be accomplished easily. To be more specific, replenishment of mailpieces to provide for sufficient buffer (or temporary storage of mailpieces) which becomes necessary particularly during high-speed operation of the apparatus can be made easily over the entire range on the conveyer belt 1*a*. The replenishment can be made continuously for a long distance, for example more than 1 meter, without allowing load of weight to be applied to the forefront mailpiece by other mailpieces arranged therebehind.

Referring to FIG. 2 showing a number of mailpieces 3 arranged on the mailpiece supply conveyer 1 (not shown in the drawing) in backward tilted position, a pair of mailpiece stops 8 is provided adjacently to the forward or downstream end of the supply conveyer 1 and a reflection type photo sensor 6 is located between the paired mailpiece stops 8 for detecting the bottom edge of a mailpiece 3 which is then moved to the forefront position on the supply conveyer 1. Though not shown specifically in the drawing, the mailpiece supply conveyer 1 is operable to move its endless conveyer belt la in response to a detection signal from the sensor 6. For example, when the forefront mailpiece 3 detected by the sensor 6 has been moved away from the detectable range of the sensor 6, which then becomes into a non-detecting state, the conveyer belt 1*a* of the supply conveyer 1 is moved until the next mailpiece is detected by the sensor 6 so that the forefront mailpiece in the array is always located at a predetermined foremost position on the supply conveyer 1.

FIG. 3 shows an example of application of transmission type photo sensor 7 and also an arrangement of mailpieces 3 in which several mailpieces adjacent to the stops 8 are pushed upward or lifted slightly off from the surface of the conveyer belt 1*a*. As a matter of course, any suitable sensor may be used for the purpose of detecting the forefront mailpiece 3, such as proximity switch of capacitance type or distance meter type sensor. Selection of the sensors may be determined according to various factors such as the presence or absence of the mailpiece stops 8, the shape of the stops 8 if any used, etc.

Figure 4:
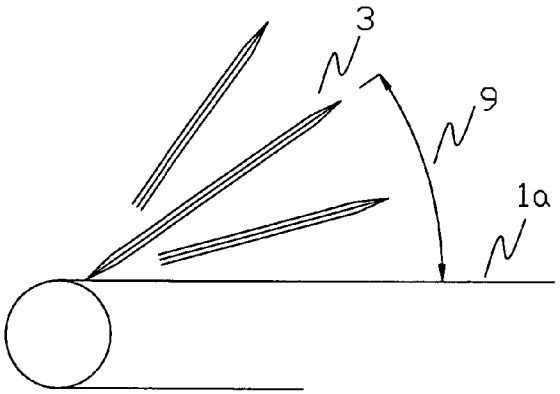
FIG. 4 is a partial front view showing various angles at which the mailpiece is tilted on the mailpiece supply conveyer with respect to the top surface thereof.

FIG. 4 shows a mailpiece 3 slanted at various angles with respect to the top surface of the supply conveyer belt 1*a*. The angle may be in the range from 15 to 60 degrees, but it should preferably be from 25 to 40 degrees as indicated by numeral 9 in the drawing. The apparatus should be designed in view of the slant angle of mailpieces 3 that is variable depending on the working conditions of the apparatus. For example, the suction pad 2*a* may be constructed in the form of a flexible bellows so that the orientation of the suction pad 2*a* is changeable depending on the angle at which the mailpiece is slanted. Since the suction pad 2*a* is usually made of an elastic material such as rubber and the mailpiece itself is usually flexible, however, the relation between the mailpiece and the suction pad 2*a* in terms of the engagement therebetween does not have to be very strict.

Figure 5:
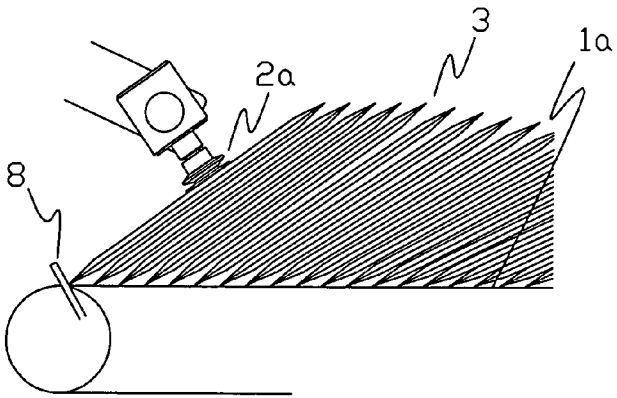
FIG. 5 is also a partial front view showing a position of engagement of a suction pad of the mailpiece suction feeder with a mailpiece.

FIG. 5 shows a position of engagement of the suction pad 2*a* with the forefront mailpiece 3 that is, unlike the position in FIG. 1, substantially the center of the front face of the mailpiece 3. The position of engagement of the suction pad 2*a* with the mailpiece 3 should be determined according to the position of the forefront mailpiece 3 on the supply conveyer 1.

Referring now to FIGS. 6 through 9, the following will describe in detail the mailpiece suction feeder 2.

The mailpiece suction feeder 2 includes a stationary frame 10 and a rotary drum 12 which is housed in the frame 10 and rotatably supported by bearings 14. The rotary drum 12 is driven to rotate about its axis 12*a* (indicated by dashed line) by a cogged belt (not shown) trained around a pulley 13 and driven by a motor (not shown). A drive shaft 20 for the suction pad holder 27 is rotatably supported by a pair of needle bearings 25 in the rotary drum 12 in a cantilever manner in parallel to the axis of rotation 12*a* of the drum 12. As shown clearly in FIGS. 6 and 7, the drive shaft 20 is disposed in the rotary drum 12 with its axis offset from the axis of rotation 12*a* of the rotary drum 12 by a given distance. An external gear 19 is fixedly mounted on the drive shaft 20 at the rear end thereof for rotation therewith in engagement with an internal gear 11 which is fixedly mounted to the stationary frame 10 of the mailpiece suction feeder 2. Engagement of the internal and external gears 11 and 19 is shown most clearly in FIG. 7. Thrust load of the drive shaft 20 is taken by a pair of thrust bearings 26. In the present embodiment, the external gear 19 has 80 teeth and a module of 2.5 mm, while the internal gear 11 has 100 teeth and the same module as the external gear 19, thus the gear ratio thereof being 4:5. The amount of offset of the axis of the drive shaft 20 from the axis 12*a* of the rotary drum 12 is determined inevitably by the above gear specifications, and the offset amount in the present case is 25 mm.

The suction pad holder 27 of crisscross shape having four radial arms 27*a* is fixedly mounted on the drive shaft 20 at the front end thereof. Each arm 27*a* of the suction pad holder 27 carries two suction pads 2*a* which are spaced in the longitudinal direction of the drive shaft 20, as most clearly seen in FIG. 6. Specifically, each arm 27*a* has at its distal end one pad pin 28 which has fixed thereto two pad fittings 29 each having one suction pad 2*a*. Air passage 28*a* is formed in each pad pin 28 and connected via secondary air tube 30 (depicted by dashed line) to a valve mechanism which will be described below.

Figure 6:
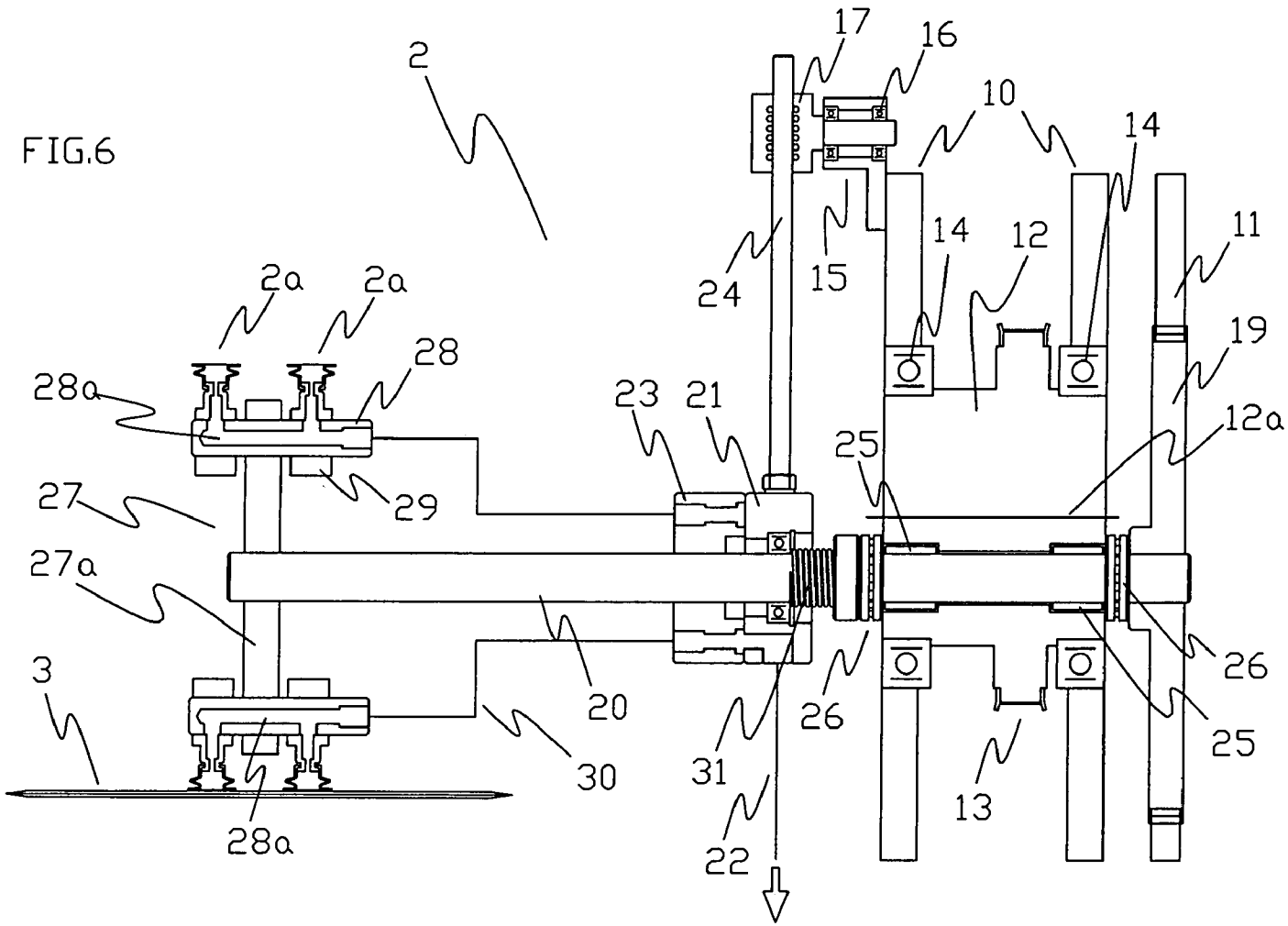
FIG. 6 is a partially cross-sectional detail side view showing the mailpiece suction feeder.
Figure 7:
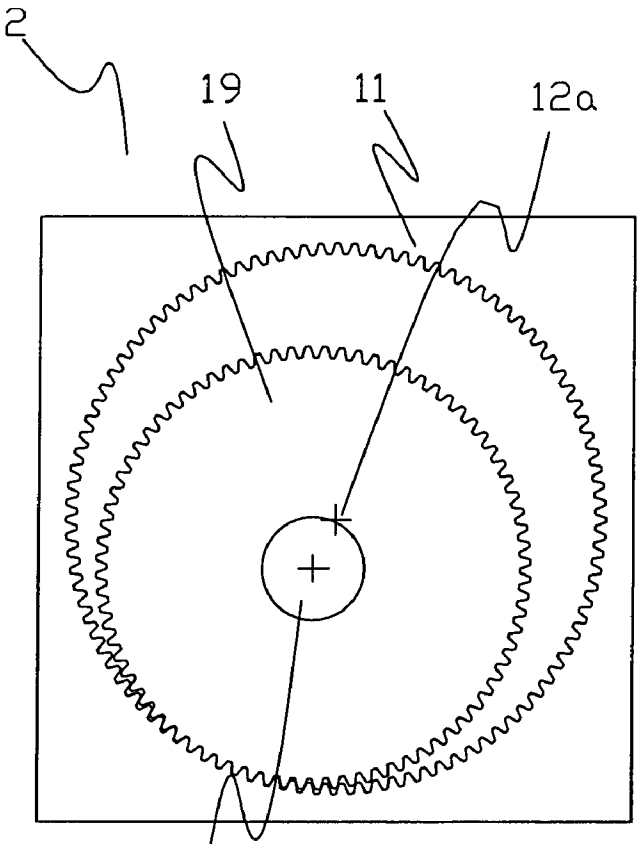
FIG. 7 is a rear view of the mailpiece suction feeder, showing internal and external gears in engagement with each other.

The valve mechanism in the present embodiment is provided by a mechanical change valve having a stator 21 and a rotor 23 both mounted on the drive shaft 20. The stator 21 is rotatably mounted on the drive shaft 20 via a bearing, but it is prevented by a stop rod 24 from being rotated with the drive shaft 20. That is, rotation of the stator 21 is restrained by a bearing assembly 15 which includes a radial bearing 16 and a slide bearing 17 and is fixed to the frame 10 for regulating the movement of the stop rod 24 in a manner that is well known to those skilled in the art. As indicated by dash line, a primary air tube 22 connected to a suitable suction source is connected to the stator 21. On the other hand, the rotor 23 is fixedly mounted on the drive shaft 20 for rotation therewith and the aforementioned secondary air tube 30 is connected at one end thereof to the air passage 28*a* of the pad pin 28 and at the other end thereof to the rotor 23. For ensuring airtightness between the sliding surfaces of the stator 21 and the rotor 23, a spring 31 is mounted on the drive shaft 20 for urging the stator 21 against the rotor 23, as shown in FIG. 6. Though valve mechanism of a mechanical type is used for the mailpiece suction feeder 2 in the present embodiment, an electrically-controlled valve mechanism may be used as required. Valve mechanism of either mechanical or electrical type should preferably be designed to be operable in such a way that the paired suction pads 2*a* are activated to pick up and hold a mailpiece 3 in the region between the points 18*a* and 18*b* of the moving path 18 of the suction pads 2*a*, shown in FIGS. 8 and 9, which will be described in later part hereof. Alternatively, the valve mechanism may be made so as to be adjustable such that paired suction pads 2*a* are activated at a position just before the point 18*a* is reached or after the suction pad 2*a* has moved past the point 18*a*. Though the paired suction pads 2*a* are deactivated at the point 18*b* in the illustrated embodiment, deactivation may occur immediately before or after the point 18*b* is reached or, alternatively, the point of deactivation may be changed to the point 18*c* or 18*d*, as required. In order to release a mailpiece 3 positively from the suction pads 2*a*, a method of so-called vacuum break may be used by allowing the atmospheric pressure to be introduced into the air passage 28*a* or replacing the vacuum with pressurized air simultaneously with the vacuum shut-off operation.

Figure 8:
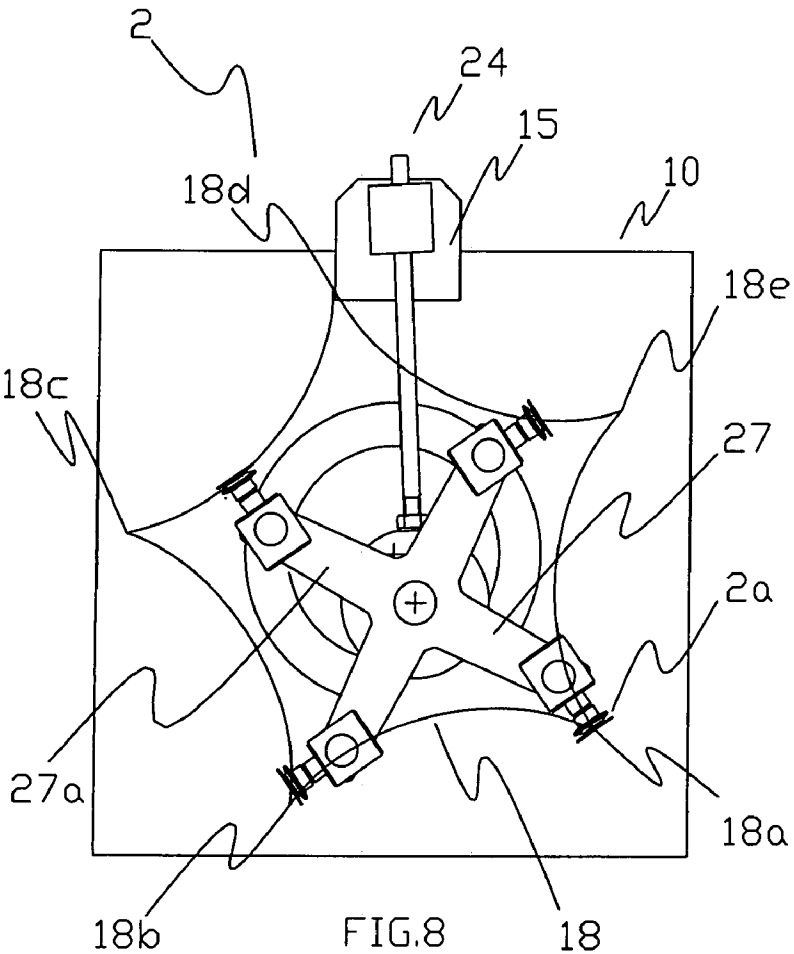
FIG. 8 is a front view of the mailpiece suction feeder, showing suction pads of the mailpiece suction feeder and their path of movement in operation of the mailpiece feeding apparatus.
Figure 9:
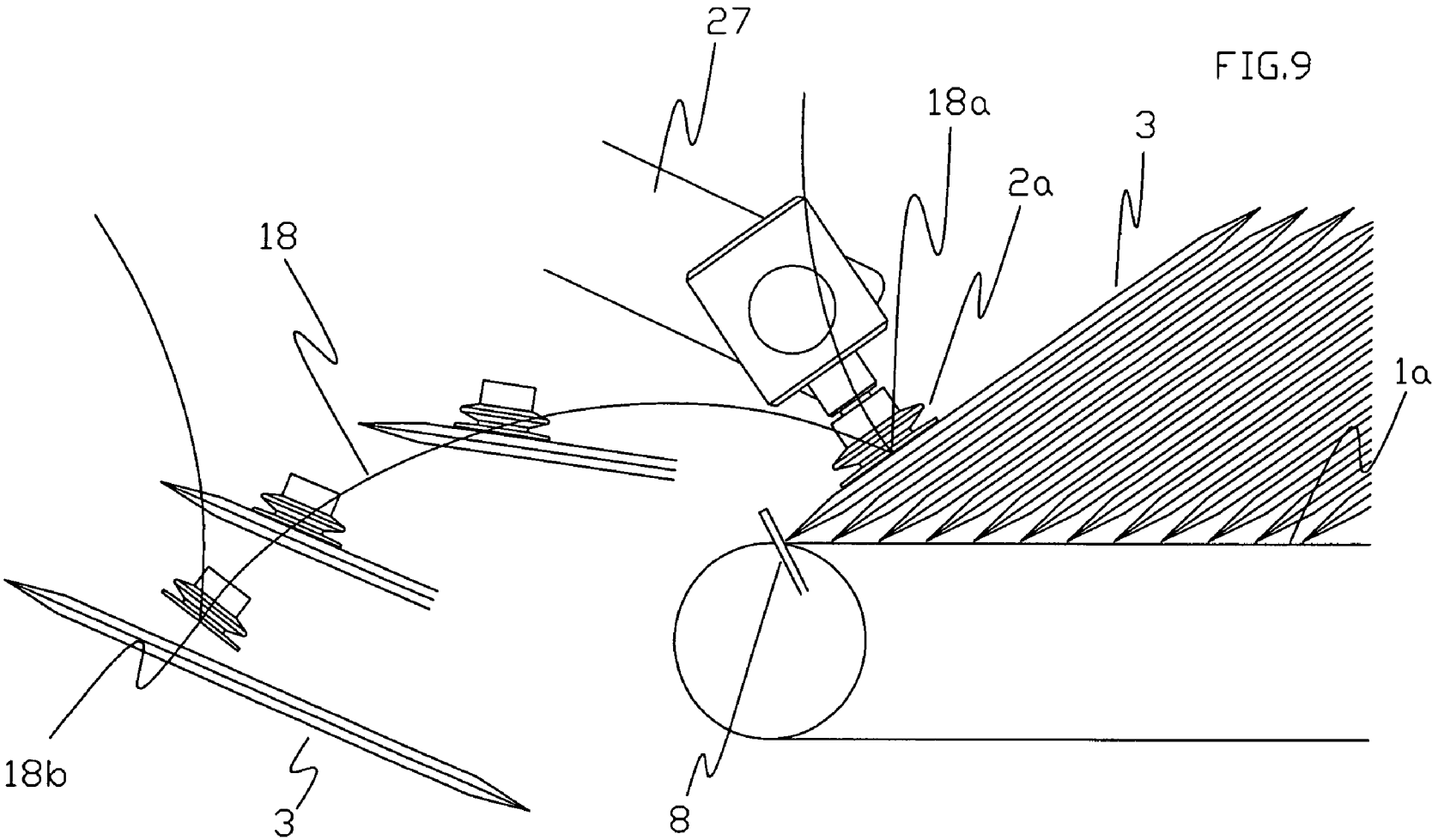
FIG. 9 is a partial front view showing part of the path of movement of a suction pad in which a mailpiece is picked up and transferred by the suction feeder.

As the rotary drum 12 is rotated, the suction pad 2*a* carried by the holder 27 which is fixedly mounted on the drive shaft 20 is moved while following the path that is indicated by reference numeral 18 in FIG. 8. Part of the path is shown in FIGS. 1 and 9. This path 18 of the suction pad 2*a* is determined by the gear specifications of the external and internal gears 19 and 11. Specifically, the path 18 describes a shape that is similar to a pentagon, but having five points which are connected by inwardly curved lines, as shown in FIG. 8. The gear ratio between the external and internal gears 19, 11 of the mailpiece suction feeder 2 may be changed to other ratios, e.g. 3:4. In this case, however, the suction pad holder 27 will have three radial arms and the suction pad 2*a* carried by the arm will describe a path whose shape is similar to a square, having four points which are connected by inwardly curved lines. In the case of the gear ratio 5:6, the suction pad holder 27 will have five radial arms and the suction pad 2*a* will describe a path whose shape is similar to a hexagon, having six points connected by inwardly curved lines. Furthermore, in the case of the gear ratio 6:7, the suction pad holder 27 will have six radial arms and the suction pad 2*a* will describe a path whose shape is similar to a heptagon, having seven points connected by inwardly curved lines. Thus, the gear ratio between the external gear 19 and the internal gear 11 should be n:n+1, wherein n represents an integer. With any one of the different gear ratios, the valve mechanism should be designed such that a mailpiece is transferred successfully from the mailpiece supply conveyer 1 to the delivery table 5 by appropriately activating and deactivating the suction pad 2*a* on the path thereof.

As is appreciated from the foregoing, the suction pad 2*a* as a suction pick-up means of the mailpiece suction feeder 2 makes a smooth continuous movement without interrupted movement such as reciprocal or intermittent motion, with the result that the apparatus is capable of feeding mailpieces at a fast speed.

Figure 10:
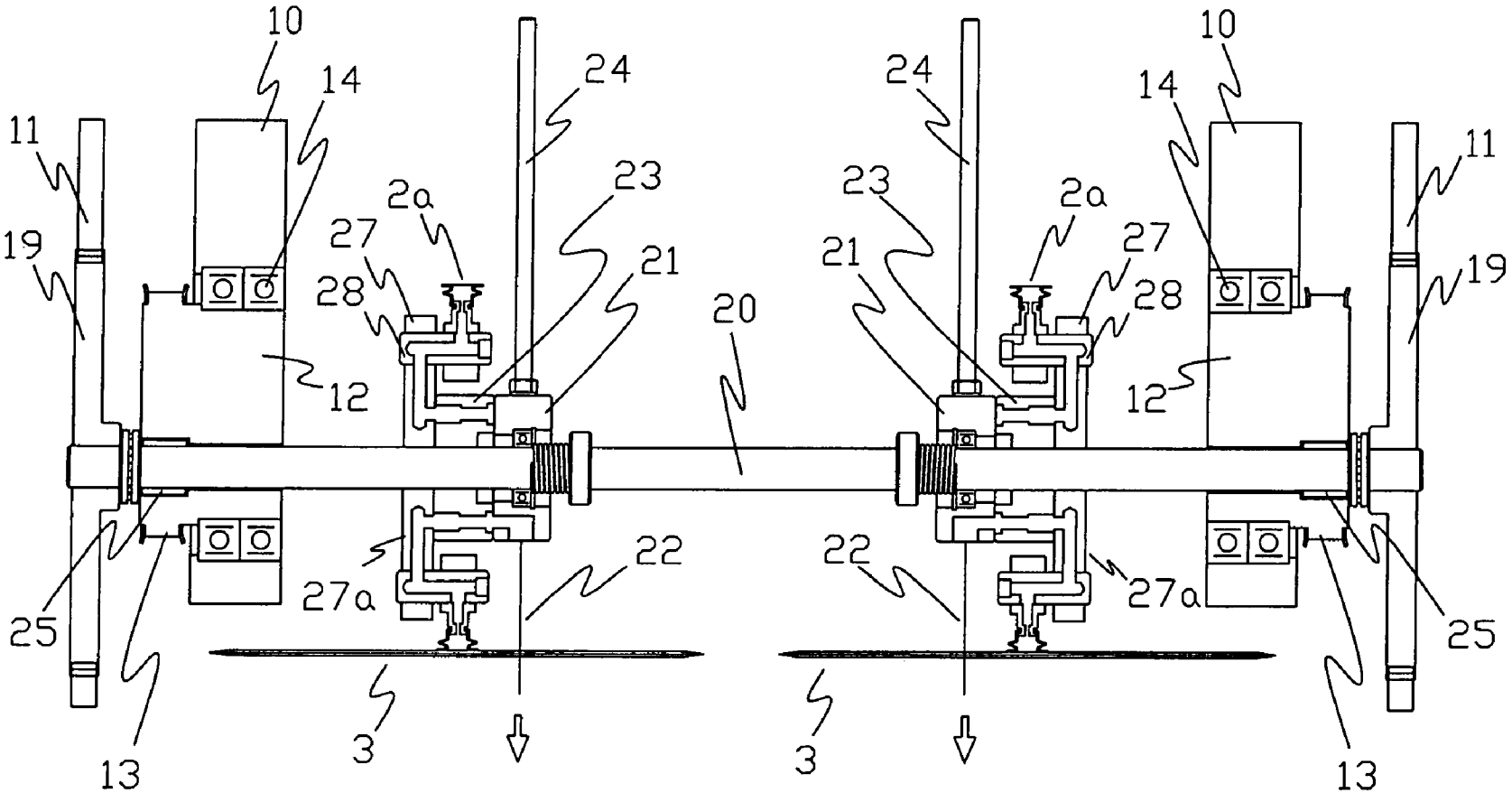
FIG. 10 is a side view showing an application of the mailpiece feeding apparatus of the present invention using two units of the mailpiece suction feeder arranged in side-by-side relation.

Then referring to FIG. 10, there is shown an example of application of the mailpiece feeding apparatus. It is noted that in the drawing those parts or elements which correspond to the counterparts of FIG. 6 are designated by the same reference numerals. In this example, the apparatus is designed to handle mailpieces 3 in two different lines simultaneously and, therefore, two sets of the mailpiece suction feeders 2 of symmetrical structure are juxtaposed or provided in side-by-side relation and, though not shown in the drawing, two sets of mailpiece supply conveyers are disposed upstream of the mailpiece suction feeders 2, respectively. The two mailpiece suction feeders 2 have in common the drive shaft 20 which is supported at the opposite end portions thereof by needle bearings 25 in the rotary drums 12 and extend through the rotary drums 12 in the same manner as in the first preferred embodiment. The drive shaft 20 has fixed thereto at the opposite ends thereof external gears 19 which are in engagement with the stationary internal gears 11 which are fixed to the respective suction feeder frames 10. Two suction pad holder 27 are fixedly mounted on the drive shaft 20 and each holder 27 has four radial arms 27*a*. Unlike the embodiment of FIG. 1, each radial arm 27*a* of FIG. 10 has only one suction pad 2*a*. The valve mechanism of FIG. 10 is substantially the same as that of the first preferred embodiment, but differs therefrom in that the valve mechanism dispenses with the secondary air tube 30 of FIG. 6 and that the air passage in the rotor 23 is connected to the air passage in the pad pin 28 through an air passage formed in the radial arms 27*a* of the suction pad holder 27. Arranging the valve mechanism without the secondary air tube, the mailpiece suction feeder 2 can be simplified in structure. As is apparent to those skilled in the art, the number of the suction pad 2*a* for each pad pin 28 or the size of the suction pad 2*a* may be increased or changed depending on various conditions such as weight of mailpieces to be handled by the apparatus. As a matter of course, the number of mailpiece feeding lines may be increased as required.

Now referring to FIGS. 11 through 14, a second embodiment of the mailpiece feeding apparatus according to the present invention will be described. It is noted that those parts or elements in the second embodiment which correspond to the counterparts of the first embodiments are labeled with the same reference numeral increased by 100, for example the mailpiece suction feeder 102 against its counterpart suction feeder 2 of the first embodiment.

Figure 11:
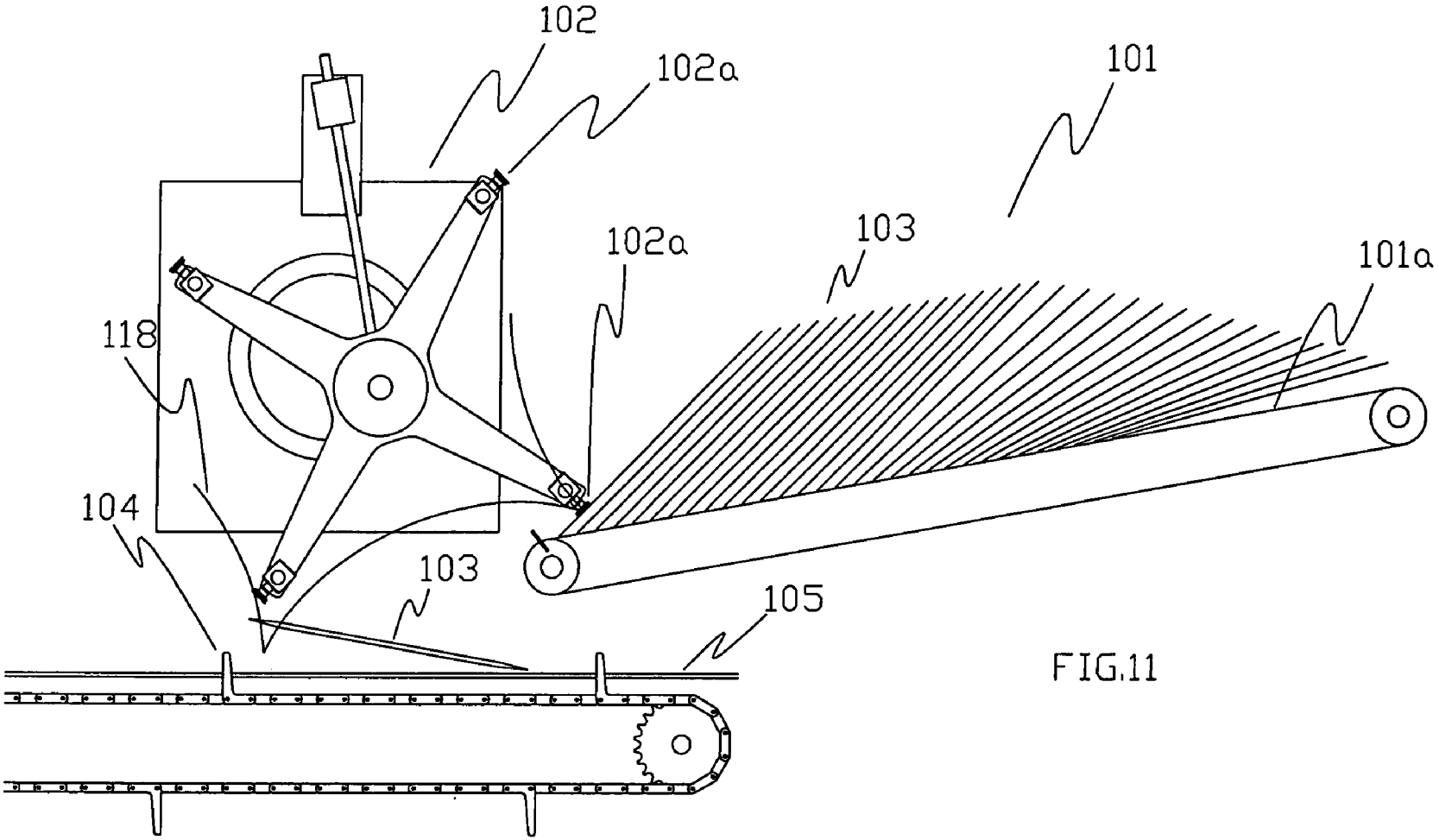
FIG. 11 is a front view of a second preferred embodiment of the mailpiece feeding apparatus according to the present invention.

As shown in FIG. 11 which is similar to FIG. 1, the mailpiece supply conveyer 101, the mailpiece suction feeder 102 and the mailpiece delivery table 105 are disposed substantially in the same relation to each other as in the first embodiment, but the mailpiece supply conveyer 101 is tilted to provide a downward slope and, specifically, each mailpiece 103 is larger in size than the mailpiece 3 in FIG. 1. The description about the mailpiece supply conveyer 101 and the mailpiece delivery table 105 will be omitted since these devices and their related parts are of substantially the same structure as the counterparts of the first embodiment.

Figure 12:
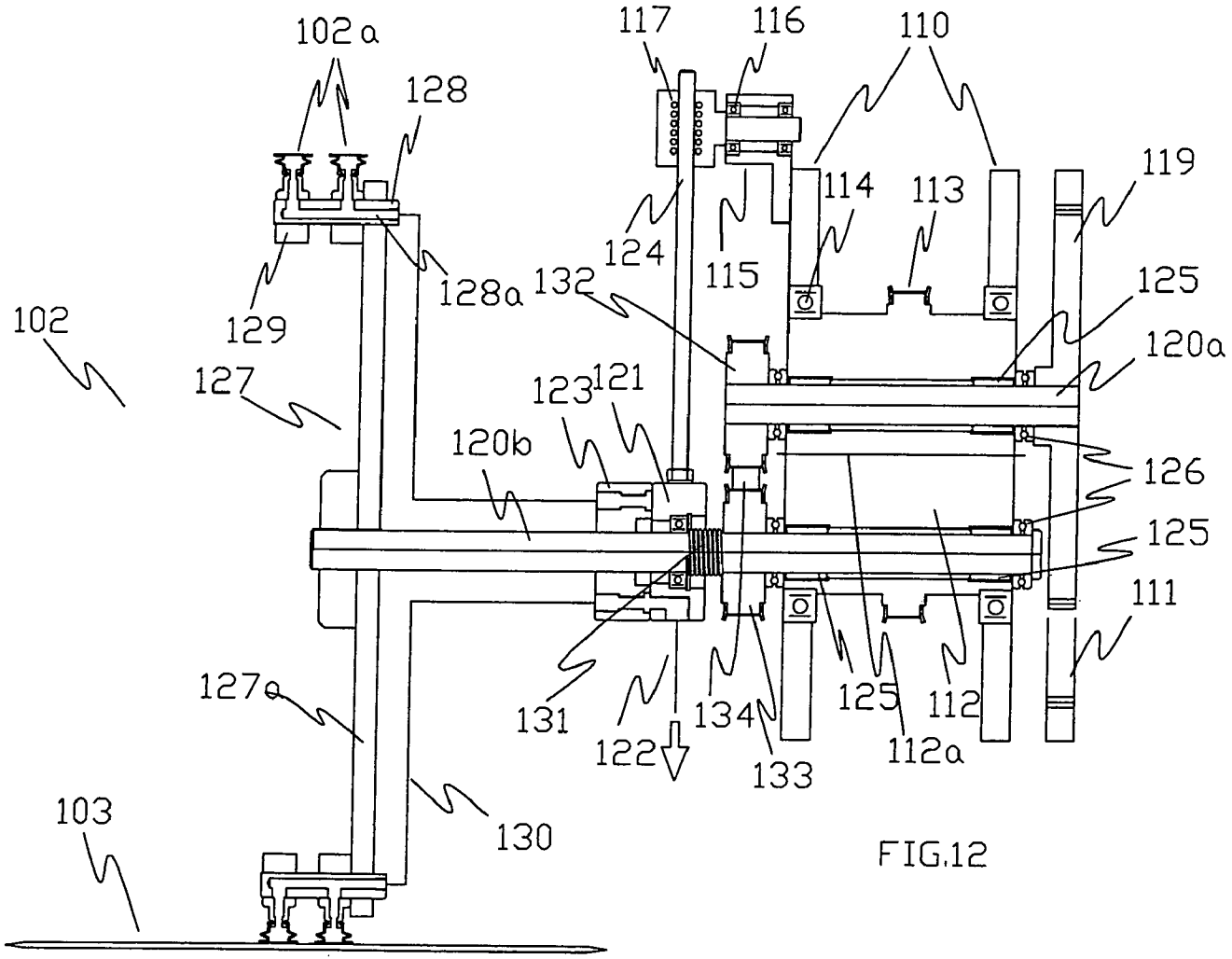
FIG. 12 is a partially cross-sectional detail side view showing the mailpiece suction feeder of the apparatus of FIG. 11.
Figure 13:
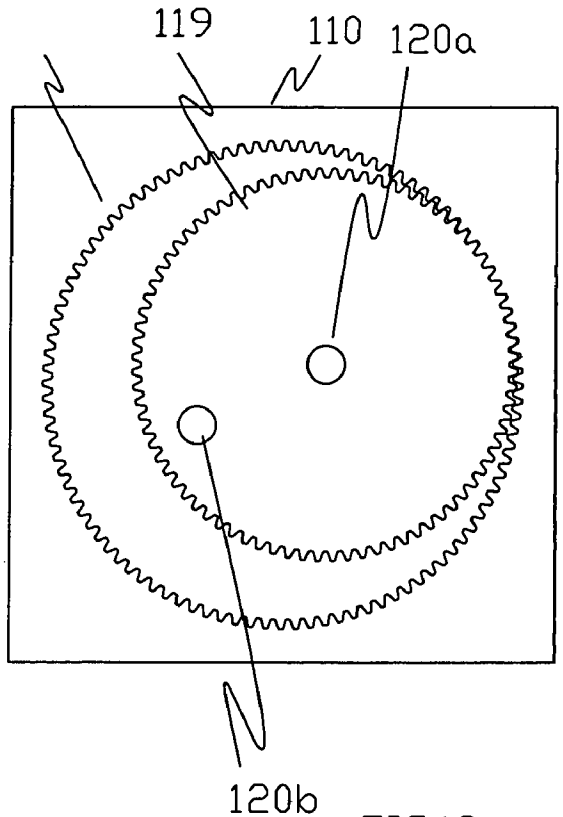
FIG. 13 is a rear view of the mailpiece suction feeder of FIG. 12, showing internal and external gears in engagement with each other.
Figure 14:
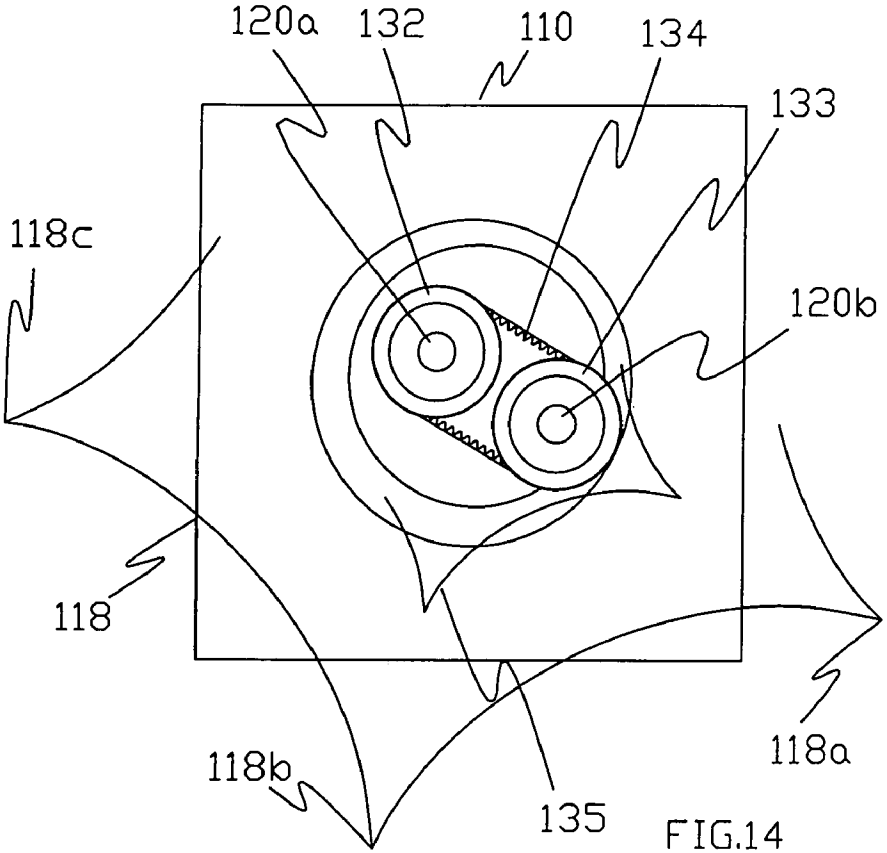
FIG. 14 is a front view of the mailpiece suction feeder, showing a cogged belt trained between a pair of pulleys and also the path of movement of a suction pad of the mailpiece suction feeder.

Referring to FIGS. 12 through 14, the following will describe the mailpiece suction feeder 102.

The mailpiece suction feeder 102 includes a rotary drum 112 which is rotatably supported by bearings 114. The rotary drum 112 is housed in a frame 110 of the mailpiece suction feeder 102 and driven to rotate about its axis 112*a* (indicated by dashed line) by a cogged belt (not shown) trained around a pulley 113 and driven by a motor (not shown). A countershaft 120*a* is rotatably supported by a pair of needle bearings 125 in the rotary drum 112, extending through the rotary drum 112 in parallel to the axis 112*a* thereof. As shown in FIG. 12, the countershaft 120*a* is disposed with its longitudinal axis offset from the axis of rotation 112*a* of the rotary drum 112 by a given distance. An external gear 119 is fixedly mounted on the countershaft 120*a* at the rear end thereof for rotation therewith in engagement with an internal gear 111 which is fixedly mounted to the frame 110 of the suction feeder 102. Engagement of the internal and external gears 111 and 119 is shown in FIG. 13. A pulley 132 is fixedly mounted on the countershaft 120*a* at the front end thereof outside the rotary drum 112. Thrust load of the countershaft 120*a* is received by a pair of thrust bearings 126. In the present embodiment, the external gear 119 and the internal gear 111 have the same number of teeth and the same module as the gears 19 and 11 of the first embodiment, respectively, and, therefore, the axis of the countershaft 120*a* is offset from the axis 112*a* of the rotary drum 112 by a distance of 25 mm. As in the first embodiment, the gear ratio between the external gear 119 and the internal gear 111 should be n:n+1, wherein n represents an integer.

On the other hand, a drive shaft 120*b* for the suction pad holder 127 is rotatably supported by a pair of needle bearings 125 in the rotary drum 112 in a cantilever manner in parallel to the axis of rotation 112*a* of the drum 112. As shown in FIG. 12, the drive shaft 120*b* is disposed in the rotary drum 112 with its longitudinal axis offset from the axis of rotation 112*a* of the rotary drum 112 by a predetermined distance, for example, 50 mm that is greater than the above offset distance of 25 mm. The drive shaft 120*b* has a pulley 133 which is connected via a cogged belt 134 with the aforementioned pulley 132 on the countershaft 120*a* so that the two shafts 120*b* and 120*a* make synchronized rotation in the same direction. The connection of these two pulleys 132 and 133 through the cogged belt 34 is also shown in FIG. 14 and the pulley ratio in the present embodiment is set preferably at 1:1. It is noted that the pulley ratio is not limited to 1:1, but it may be changed to other ratios of two integer numbers such as 5:4, 4:3 or 2:1 or 4:5, 3:4, 1:2.

The suction pad holder 127 is of substantially the same structure as the counterpart 27 of the first embodiment of FIG. 6. The suction pad holder 127 of crisscross shape having four radial arms 127*a* is fixedly mounted on the drive shaft 120*b* at the front end thereof remote from the rotary drum 112. Each arm 127*a* of the suction pad holder 127 carries two suction pads 102*a* which are spaced in the longitudinal direction of the drive shaft 120*b*. Specifically, each arm 127*a* has at its distal end one pad pin 128 and two pad fittings 129 each having one suction pad 102*a*. As shown in FIG. 12, air passage 128*a* is formed in the pad pin 128 and connected via secondary air tube 130 (depicted by dashed line) to a valve mechanism.

The valve mechanism in this second embodiment is also substantially the same as that of the first embodiment. A stator 121 is rotatably mounted on the drive shaft 120*b* through a bearing and prevented from being rotated with the drive shaft 120*b* by a stop rod 124 whose movement is regulated by a bearing assembly 115 including a radial bearing 116 and a slide bearing 117 and fixed to the frame 110. As indicated by dash line, the stator 121 is connected to one end of a primary air tube 122, the other end of which is connected to a suitable suction source. On the other hand, the rotor 123 is fixedly mounted on the drive shaft 120*b* for rotation therewith, and the aforementioned secondary air tube 130 is connected at one end thereof to the rotor 123 and at the other end thereof to the air passage 128*a* in each pad pin 128. For ensuring airtightness between the sliding surfaces of the stator 121 and the rotor 123, a spring 131 is mounted on the drive shaft 120*b* for urging the stator 121 against the rotor 123, as shown in FIG. 12.

As the rotary drum 112 is rotated, the suction pad 102*a* which carried by the holder 127 which is in turn fixed on the drive shaft 120*b* is moved along a path that is indicated by reference numeral 118 in FIG. 14. In the drawing, reference numeral 135 shows an imaginary path of a suction pad in an assumptive case wherein the countershaft 120*a* has an extension carrying at the end thereof a suction pad holder and the suction pads on radial arms of the suction pad holder are located on the pitch circle of the internal gear 111. That is, the imaginary path 135 corresponds to the path 18 of the suction pad 2*a* in the first embodiment. As is appreciated from comparison of the two paths, according to the second embodiment, the suction pads 102*a* can be located radially further from the axis 112*a* of the rotary drum 112 than the suction pads 2*a* in the first embodiment. Thus, the suction pad 102*a* of the suction feeder 102 of the present second embodiment can move while following a path that is greater than the path 135 for the first embodiment, with the result that mailpieces of a larger size can be handled successfully.

As stated earlier with reference to the first embodiment, the amount of offset of the axis of the drive shaft 20 from the axis 12*a* of the rotary drum 12 is determined by the gear specifications and, therefore. According to the second embodiment, however, the offset distance between the drive shaft 120*b* and the rotary drum 112 is not restricted, but the drive shaft 120*b* can be arranged with the desired offset distance from the axis 112*a* of the rotary drum 112. In the case of the second embodiment, setting this offset distance greater than 25 mm will enlarge the path for the suction pads 102*a*, while shortening the offset distance will reduce the path. Thus, the provision of the additional countershaft 120*a* in the second embodiment makes it possible not only to enlarge the path thereby permitting handling of mailpieces of larger size, but also to construct the mailpiece feeding apparatus smaller in size for a given size of path. Additionally, this also contributes to improving the degree of freedom in designing a mailpiece feeding apparatus.

For transmitting accurately the movement of the countershaft 120*a* that is constrained due to the engagement of the internal and external gears 111 and 119 to the drive shaft 120*b*, the cogged belt 134 which is trained between the pulleys 132 and 133 is used. As is apparent to those skilled in the art, the combination of the cogged belt 134 and pulleys may be substituted by any suitable transmission means such as gears as far as the countershaft 120*a* and the drive shaft 120*b* are rotated in the same direction. In case of using gears, the gear ratio should preferably be 1:1, but other gear ratios such as 1:2 or 2:1 may be selected. When gear ratio other than 1:1 is selected, however, the shape of the path will be changed.

In the case of the second embodiment wherein the gear ratio of the external and internal gears 119 and 111 is 4:5, the path 118 of the suction pad 102*a*, which is only partially shown in FIG. 14, describes a shape similar to a pentagon, but having five points which are connected by curved lines as in the case of the first embodiment. For different gear ratios such as 3:4, 5:6 and 6:7, the description made for the first embodiment is true of the second embodiment, too.

Figure 15:
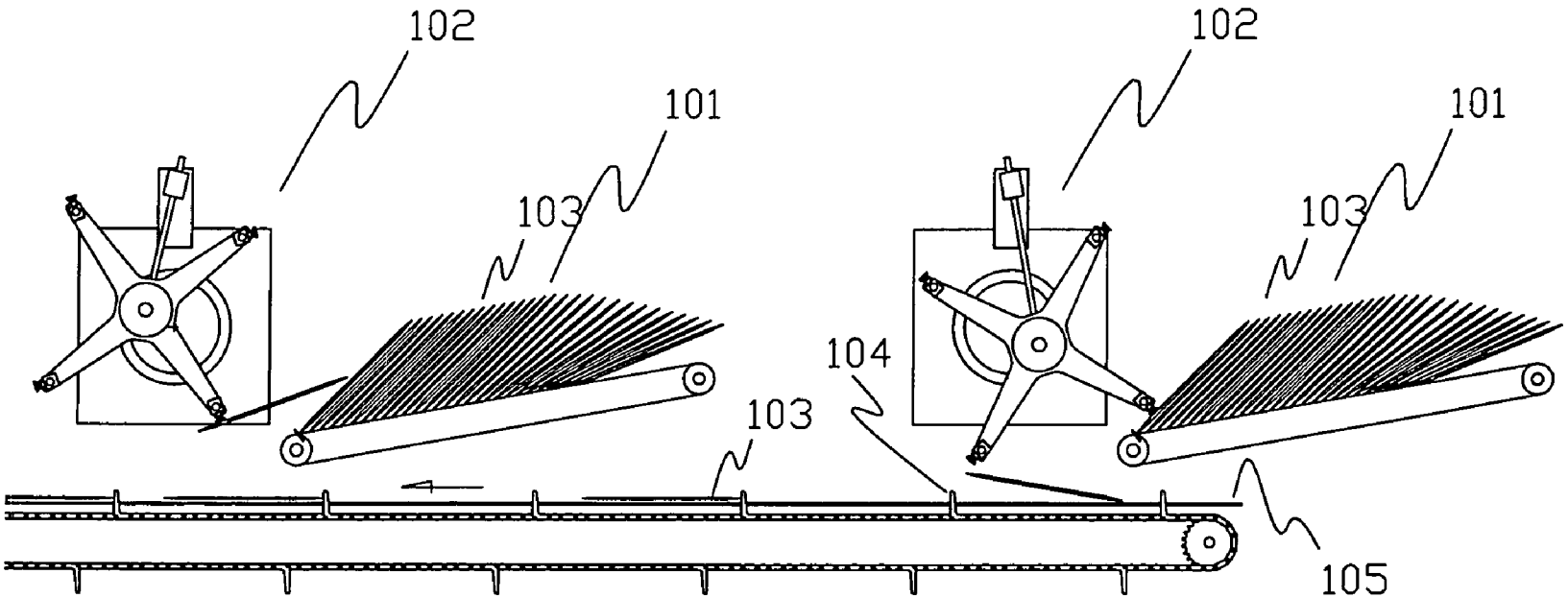
FIG. 15 a front view showing an application of the mailpiece feeding apparatus of the present invention using two units of the mailpiece suction feeder arranged in tandem relation.

Now referring to FIG. 15 showing an example of application of the mailpiece feeding apparatus according to the second embodiment, two units of mailpiece suction feeders 102 are arranged together with their associated mailpiece supply conveyers 101 in tandem relation along a single mailpiece delivery table 105. The whole mailpiece feeding system of FIG. 15 is operable in such a way that the mailpiece suction feeder 102 on the upstream side (or on the right-hand side on the drawing) places mailpieces 103 onto every other section on the delivery table 105 and the other suction feeder 102 on the downstream side places mailpieces onto the remaining sections on the delivery table 105. In other words, two units of the feeding apparatus operate in conjunction with each other so as to fill all the delivery table sections. Depending on the mailpiece handling capacity of the subsequent working station, an additional mailpiece feeding apparatus may be provided along the delivery table 105. Though the chain fingers 104 are moving in arrow direction, it may be so arranged that the chain fingers 104 are movable in opposite direction as far as the mailpiece feeding by the suction feeder 102 is performed in synchronism with the chain finger movement. In the arrangement of FIG. 15, the general direction in which the mailpieces 103 are transferred to the delivery table 5 by the suction feeder 102 coincides with the direction in which the mailpieces 103 on the table 105 are conveyed by the chain fingers 104. However, the supply conveyer 101 and the suction feeder 102 may be arranged relative to the delivery table 105 such that the mailpieces 103 are moved by the suction feeder 102 in perpendicular relation to the movement of the chain fingers 104.

As would be now apparent to those skilled in the art from the foregoing description, the mailpiece feeding apparatus according to the present invention is capable of handling mailpieces of varying thicknesses successfully. The suction feeder which causes the suction pad as the mailpiece pick-up means to move continuously without making interrupted movement such as reciprocal motion makes possible mailpiece feeding operation at an increased speed.

While the invention has been described and illustrated with reference to the specific embodiments, it is to be understood that the invention can be practiced in other various changes and modifications without departing from the spirit or scope thereof.

What is claimed is:

1. An apparatus of feeding mailpieces, comprising:

a supply conveyer for supporting thereon an array of mailpieces which are arranged in a tilted-backward position and moving such mailpieces forward; and a suction feeder located adjacent to the downstream end of said supply conveyer as viewed in the direction in which the mailpieces are moved by said supply conveyer, for picking up by suction a forefront mailpiece from said array of mailpieces on said supply conveyer;

said suction feeder having a drum rotatable about its axis, a shaft rotatably supported in said drum and extending with the axis thereof oriented in parallel to and offset from the axis of said drum, an external gear fixed on said shaft for rotation therewith, a stationary internal gear engaging with said external gear, the gear ratio of said external gear to said internal gear being n:n+1, wherein n represents an integer, and a plurality of suction means arranged at positions which are radially spaced at a predetermined distance from said shaft and substantially equally angularly spaced from each other and movable integrally with said shaft in conjunction with the rotation of said drum for picking up each forefront mailpiece from said array of mailpieces on said supply conveyer.

2. An apparatus of feeding mailpieces according to claim 1, wherein said supply conveyer has means for positioning the forefront mailpiece of said array of mailpieces at a predetermined position on said supply conveyer.

3. An apparatus of feeding mailpieces according to claim 1, wherein said gear ratio is 4:5 and said suction means are arranged at four angularly spaced positions.

4. An apparatus of feeding mailpieces according to claim 1, wherein said suction feeder has a valve mechanism for controlling activation and deactivation of said suction means.

5. An apparatus of feeding mailpieces according to claim 1, wherein said suction means includes a suction pad.

6. An apparatus of feeding mailpieces, comprising:

a supply conveyer for supporting thereon an array of mailpieces which are arranged in a tilted-backward position and moving such mailpieces forward; and a suction feeder located adjacent to the downstream end of said supply conveyer as viewed in the direction in which the mailpieces are moved by said supply conveyer, for picking up by suction a forefront mailpiece from said array of mailpieces on said supply conveyer;

said suction feeder having a drum rotatable about its axis, a first shaft rotatably supported in said drum and extending with the axis thereof oriented in parallel to and offset from the axis of said drum, an external gear fixed on said first shaft for rotation therewith, a stationary internal gear engaging with said external gear, the gear ratio of said external gear to said internal gear being n:n+1 wherein n represents an integer, a second shaft rotatably supported in said drum, extending with the axis thereof oriented in parallel to the axis of said first axis and offset from the axis of said drum by a predetermined distance and connected with said first shaft for synchronized rotation therewith in the same direction, and a plurality of suction means arranged at positions which are radially spaced at a predetermined distance from said shaft and substantially equally angularly spaced from each other and movable integrally with said shaft in conjunction with the rotation of said drum for picking up each forefront mailpiece from said array of mailpieces on said supply conveyer.

7. An apparatus of feeding mailpieces according to claim 6, wherein said supply conveyer has means for positioning the forefront mailpiece of said array of mailpieces at a predetermined position on said supply conveyer.

8. An apparatus of feeding mailpieces according to claim 6, wherein said gear ratio is 4:5 and said suction means are arranged at four angularly spaced positions.

9. An apparatus of feeding mailpieces according to claim 6, wherein said second shaft is connected with said first shaft with the speed ratio of 1:1.

10. An apparatus of feeding mailpieces according to claim 6, wherein the axis of said second shaft is offset from the axis of said drum by a distance that is greater than the distance by which the axis of said first shaft is offset from the axis of said drum.

11. An apparatus of feeding mailpieces according to claim 6, wherein said suction feeder has a valve mechanism for controlling activation and deactivation of said suction means.

12. An apparatus of feeding mailpieces according to claim 6, wherein said suction means includes a suction pad.

* * * * *